US007008169B1

(12) United States Patent
Miyanishi

(10) Patent No.: US 7,008,169 B1
(45) Date of Patent: Mar. 7, 2006

(54) HYDRAULICALLY DRIVEN WORKING MACHINE

(75) Inventor: Masami Miyanishi, Osaka (JP)

(73) Assignee: Yanmar Co., Ltd., (JP)

( * ) Notice: Subject to any disclaimer, the term of this patent is extended or adjusted under 35 U.S.C. 154(b) by 0 days.

(21) Appl. No.: 09/719,772

(22) PCT Filed: Feb. 7, 2000

(86) PCT No.: PCT/JP00/00664

§ 371 (c)(1),
(2), (4) Date: Apr. 26, 2001

(87) PCT Pub. No.: WO00/47833

PCT Pub. Date: Aug. 17, 2000

(30) Foreign Application Priority Data

Feb. 9, 1999 (JP) ..... 11-031666
Feb. 9, 1999 (JP) ..... 11-031667
Feb. 10, 1999 (JP) ..... 11-032709

(51) Int. Cl.
*B66C 23/00* (2006.01)

(52) U.S. Cl. ..... 414/722; 414/685; 414/918

(58) Field of Classification Search ..... 414/685, 414/686, 694, 722, 918; 248/51, 52; 403/316
See application file for complete search history.

(56) References Cited

U.S. PATENT DOCUMENTS 3,220,579 A * 11/1965 Pilch ..... 414/694
D309,313 S * 7/1990 Takashima et al. ..... D15/25
5,232,330 A * 8/1993 Rae et al. ..... 414/686
6,158,949 A * 12/2000 Walth et al. ..... 414/722

FOREIGN PATENT DOCUMENTS

| | | | |
|---|---|---|---|
| JP | 56-5068 | * | 1/1981 |
| JP | 58-30851 | * | 7/1983 |
| JP | 3-103351 | * | 10/1991 |
| JP | 6-60647 | * | 8/1994 |
| JP | 8-218417 | * | 8/1996 |
| JP | 9-209385 | * | 8/1997 |
| JP | 9-296475 | * | 11/1997 |

* cited by examiner

*Primary Examiner*—Eileen D. Lillis
*Assistant Examiner*—Michael Lowe
(74) *Attorney, Agent, or Firm*—Sterne, Kessler, Goldstein & Fox, P.L.L.C.

(57) ABSTRACT

A pair of supported portions are provided in a bifurcated manner on the base end of the boom of a work machine. Operation oil hoses for an arm cylinder and operation oil hoses for a bucket cylinder are guided and piped into the boom from between both the supported portions. A hose guide hole is provided below each of the boom support portions so that operation oil hoses for the boom cylinder are inserted into the respective hose guide holes. At an intermediate portion of the rear surface of the boom, the operation oil hoses are taken out from the inside of the boom through a hose attachment plate and connected to respective external hoses connected to the arm cylinder. At a tip end of the boom, the operation oil hoses are pulled out from the inside of the boom through a rear side inclined surface of an angle rib.

10 Claims, 9 Drawing Sheets

HYDRAULICALLY DRIVEN WORKING MACHINE

CROSS-REFERENCE TO RELATED APPLICATIONS

This is the U.S. National phase application of International Application Number PCT/JP00/00664, International Filing Date: Feb. 7, 2000 which published under PCT Article 21(2) in non-English.

BACKGROUND OF THE INVENTION

1. Technical Field of the Invention

The present invention relates to a hydraulic pressure driving work machine such as a backhoe or the like attached on a swiveling work vehicle or the like. More particularly, it relates to a piping structure of operation oil hoses for supplying operation oil to hydraulic actuators for driving respective drive parts of the work machine, and relates to a reinforcement structure of a boom which is one of the drive parts thereof.

2. Description of the Related Art

There is a well known work machine such as backhoe or the like which comprise a combination of drive parts such as a boom, an arm and a work attachment (a bucket or the like), each of which are individually driven with a hydraulic actuator. Such a work machine is attached, for example, on a turntable mounted above a running machine of a swiveling type vehicle or on either a front end or a rear end or the like of a tractor, wherein operation oil hoses are extended to the hydraulic actuators for driving the respective drive parts from a hydraulic pressure controller arranged on a main body of the vehicle.

These operation oil hoses are conventionally arranged from a base end of the boom to a tip end thereof along a rear surface of the boom whose base end is vertically rotatably attached on a main body of a vehicle such as a turntable or the like (normally, via a hinge member referred to as a boom bracket) to be extended to each of the hydraulic actuators. Via the hose guide member arranged in the vicinity of the base end of the rear surface of the boom, the operation oil hoses are guided to the rear surface of the boom. In addition, at the rear of the hose guide member (a vehicle side portion), a definite space is provided so that a deflection space of the operation oil hoses can be allowed.

It is hard to say that the operation oil hoses are favorably protected in its piping structure because the operation oil hoses are exposed to the rear surface of the boom. In addition, in a vehicle structure in which driver's room (a cab) is arranged at the rear of the boom, the rearward rotation region of the boom is restricted (namely, a rise angle is restricted). Furthermore, in order to secure the deflection space of the operation oil hoses, the boom bracket must be arranged at a location shifted to the work attachment to some degree from the vehicle body. On the whole, the center of gravity of the work machine is shifted to the work attachment so as to be separated away from the position of the center of gravity of the vehicle body, whereby the stability is unfavorable. Furthermore, if the vehicle is the swiveling type vehicle, the swivel radius at work becomes large so as to make a work at a narrow place difficult.

In addition, the hydraulic actuator (for example, a bucket cylinder) for the work attachment (for example, a bucket) is arranged beside the arm, and the operation oil hoses to the hydraulic actuator must be provided on the periphery of the pivot portion of the base end of the arm onto the tip end of the boom with a deflection space which is secured following the rotation operation of the arm with respect to the boom. However, since the operation oil hoses are arranged up to the vicinity of the tip end of the rear surface of the boom, the bending degree becomes large as the arm is rotated away from the boom, thereby causing the life of the operation oil hose to be short.

Incidentally, with respect to the operation oil hoses connected to the hydraulic actuator for the arm or the work attachment, there can be seen a structure such that the boom is formed, for example, in an H-shaped cross section or a U-shaped cross section from a bent intermediate portion thereof up to the tip end portion thereof and an operation oil hose is arranged inside of the boom, namely, between both side plates of the boom. In this structure, the base end portion of the actuator (an arm cylinder) for driving the arm can be arranged inside of the boom. Therefore, the operation oil hoses and the base end of the arm cylinder do not project at the rear of the boom, thereby enabling the rearward rotation angle of the boom to be set to a large level to some extent, and being protected both the side plates and belly plates of the boom.

However, in order to facilitate the connection of the operation oil hoses and the maintenance thereof, or to secure the deflection space, between the intermediate portion and the tip end portion of the boom, the rear surface thereof must be formed into an open configuration (namely, an H-shaped cross section, a U-shaped cross section or the like). Such structure can be applied only to a small type work machine with a small capacity because the strength of the boom is not so high. In order to assume a structure such that the operation oil hoses are piped into the boom while the rear surface of the boom being covered, a structure must be secured such that the hoses can be easily connected to the hydraulic actuator and conducted and can be provided with a sufficient deflection space.

Furthermore, the hydraulic actuator (a boom cylinder) for driving the boom is normally arranged on the belly side of the boom and the base end of the actuator is pivoted on a foremost end portion of the boom bracket facing toward the work attachment. In such a state, the operation oil hoses for the boom cylinder extended from the turntable require a larger deflection around the pivoting portion of the base end of the boom when an attempt is made to pipe the operation oil hose in the vicinity of the boom bracket. Consequently, the operation oil hoses are usually piped so as to pass outsides of the boom, whereby the piping is exposed and remains unprotected which also appears visually unfavorable.

Next, referring to a reinforcement structure which is conventionally seen particularly in the boom, the support portion on the base end of the boom to be pivoted onto the boom bracket is constituted with casting material because a large load is inflicted thereon, and the support portion is joined by welding or the like to the main body of the boom, and a reinforcing plate is plastered on the joint portion to secure the strength. Consequently, a part of the reinforcing plate comes into contact with the casting support portion while the other part of the remaining part comes into contact with the steel-plate made main body of the boom. However, the conventional reinforcing plate is formed in a constant thickness so as to apply a uniform stress over the boom through its whole surface. Since the thickness of the reinforcing plate is set so that a load is inflicted upon the casting support portion, a relatively strong stress is applied to the relatively weak steel plate serving as the main body of the boom. This is not preferable in structure.

Furthermore, on the tip end portion of the boom is fixed an arm fulcrum bracket for pivoting the arm. A portion of the arm fulcrum bracket which projects from the tip end of the main body of the boom has a definite thickness so as to endure the support of the base end of the arm. When the arm fulcrum bracket is joined to the main body of the boom with this thickness, a stress is concentrated upon the main body of the boom. Consequently, a surfacing process is provided on the arm fulcrum bracket with a milling cutter or the like so as to require a large number of manpower and high cost.

DISCLOSURE OF THE INVENTION

A first object of the present invention is to provide a work machine having a plurality of drive parts which are individually controlled with hydraulic pressure. The drive parts includes a boom having a base end pivoted on a boom bracket attached on a base (a swivel body or the like of a swivel type vehicle), an arm pivoted on an utmost end of the boom, and a work attachment (a bucket or the like) pivoted on an utmost end of the arm. The drive parts are driven by respective hydraulic actuators to which operation oil hoses are extended from the base. A piping structure of the operation oil hoses and the structure of the drive parts, particularly, the boom in association with the piping are devised so as to improve endurance, protection, maintenance or the like of the operation oil hoses while securing the strength of the boom, to stabilize a structure body (a vehicle or the like) having a base on which the work machine is attached, and to reduce the swiveling radius thereof in the case where the invention is applied to the swivel type vehicle.

In order to attain the first object, according to the present invention, a hose guide member is fixed on an upper end portion of a pivot pin which vertically penetrates the base and the boom bracket so that the base and the boom are tightened thereon while being horizontally rotatable in relative to each other. Accordingly, the hose guide member and the boom bracket can be horizontally rotated together with respect to the base. The operation oil hoses extended from the base for supplying operation oil to the hydraulic actuators for driving the drive parts, particularly, the arm and the work attachment are guided and piped to the inside of the boom via the hose guide member. In the front view of the boom bracket, since the guide member is located between right and left boom support portions which are formed at the upper end of the boom bracket for respectively pivoting twin supported portions formed at the base end of the boom in a bifurcated manner, the operation oil hose which is passed through the guide member is guided into the boom via the opening at the base end of the boom between the twin supported portions while being protected at its both outsides with the boom support portions and the supported portions of the base end of the boom.

In this manner, the operation oil hoses are favorably guided into a narrow space at an upper portion of the boom bracket so that the deflection space of the operation oil hoses at the rear side of the base end of the boom is decreased, and, furthermore, the operation hoses are piped into the boom with the result that there is no operation oil hose piped on the rear surface of the boom. Consequently, the projection amount of the boom bracket toward the work attachment side is suppressed, and the rearward rotation angle of the boom is also secured, thereby stabilizing the center of gravity of the structure body such as a vehicle or the like having the base. If the work machine is attached on the swivel type vehicle, the minimum swiveling radius of a turntable serving as the base during its horizontal swiveling with respect to the running machine can be decreased so that work at a narrow place can be made possible.

Furthermore, even if the boom bracket is rotated leftward and rightward with respect to the turntable, the guide direction of the operation hoses by the guide member is varied in correspondent to the lateral rotation of the boom bracket because the guide member fixed to the upper end of the pivot pin can be rotated integrally with the boom bracket, thereby making it possible to prevent the operation oil hoses from being damaged in contact with the boom bracket and the boom. Incidentally, the guide member, when engaged with the boom bracket, can serve as a safety device for preventing the detachment of the pivot pin in a downward direction.

Furthermore, on the base end of the boom, the supported portions are formed in a bifurcated manner for pivoting the boom bracket, and, at the same time, a pair of the boom support portions are formed to pivot respective supported portions. The present invention is intended to form respective guide holes below each of the boom support portions, and to make an operation oil hose pass through each of the guide holes toward the hydraulic actuator for driving the work machine, particularly for driving the boom. Since the operation oil hose is passed to each of the guide holes so that its deflection on the boom bracket toward the center of the base (opposite to the work attachment) is decreased, the boom bracket can be allowed to come close to the central portion of the base from the work attachment. In the same manner as described above, the center of gravity of the structure body of a vehicle or the like having the base can be stabilized. At the same time, in the case where the work machine is attached on the swivel type vehicle, the minimum swiveling radius of the turntable serving as the base during its horizontal swiveling with respect to the running machine can be decreased. Furthermore, the operation oil hoses to the actuator for driving the boom which have conventionally passed outside of the boom can be allowed to pass through the boom bracket by using the guide holes with the result that the protection of the operation oil hose is improved, and its visual appearance becomes very neat and tidy.

Additionally, the boom bracket is formed on both sides of each of the boom support portions thereof with downward ribs between which a valley is provided so as to allow the operation oil hose which has penetrated the guide hole to pass thereon. Accordingly, the operation oil hose can be well guided to the boom cylinder in front of the boom bracket with a simple structure having no special hose guide member while being prevented from damage.

Furthermore, according to the present invention, end portion connectors of the operation oil hoses which are extended from the base for supporting operation oil to the hydraulic actuators for driving the respective drive parts are arranged on the upper plate portion of the base in the vicinity of the work machine, so that end portions of the operation oil hoses in connection with the respective hydraulic actuators are detachably coupled to the end portion connector. Accordingly, for providing the work machine on the base, the operation oil hoses are piped separately on the base and on the work machine in advance, the work machine is attached onto the base, and then, the operation oil hoses provided on the base are connected to those on the work machine so as to complete the piping of all the operation oil hoses from the hydraulic pressure device arranged on the base to the hydraulic actuators for driving the respective drive parts. This is remarkably simple as compared with such a labor that the operation oil hoses having the whole lengths between the base and the hydraulic actuators are piped on the work machine and connected to the respective hydraulic actuators. Furthermore, when each operation oil hose has the whole length between the hydraulic pressure device on the base and each of the hydraulic actuators, the operation oil hose must be detached over the whole length in the case of exchange in the maintenance or the like. However, in the present invention, the operation oil hose piped on the work machine and connected to each of the hydraulic actuator may only be detached from the end portion connector of the operation oil hose piped to the base. Thus, the exchange work of the operation oil hose is remarkably easy.

Furthermore, the end portion connector which is arranged on the upper plate portion of the base serves as a guide member for guiding the operation oil member connected to each of the hydraulic actuators in the optimal state up to the hose guide member and the hose guide hole and displays the effect of decreasing the deflection space of the operation oil hose.

Next, according to the present invention, a pair of brackets opposite to each other are arranged on an intermediate portion of the rear surface of the boom for pivoting the base end of the hydraulic actuator for driving the arm, and on the rear surface of the boom between both the brackets are provided a hose taking-out opening through which the operation oil hoses piped inside of the boom are extended to the outside of the boom so as to be coupled to the hydraulic actuator for driving the arm.

In addition, the boom is bent at its intermediate portion into a dogleg shape. The brackets for pivoting the base end of the hydraulic actuator for driving the arm is arranged in the vicinity of the bent intermediate portion of the boom. The hose taking-out opening is shifted to the arm from the bent portion in the rear surface of the boom. A cover attachment washer is fixed on the peripheral portion of the hose taking-out opening to reinforce the peripheral portion of the hose taking-out opening in the boom. At the same time, a cover for sealing the hose taking-out opening can be attached on the cover attachment washer while allowing the piping of the hose for the supply of operation oil to the hydraulic actuator for driving the arm.

Then, the cover attached on the cover attachment washer is formed with an inclined portion toward the inside from the rear surface of the boom along the hoses.

In the above structure, since the hose taking-out opening is surrounded with the strong brackets and the cover attachment washer is fixed to the peripheral portion, the strength at the rear surface of the boom can be secured while providing the hose taking-out opening. Even if the work machine has a large-scale, the operation oil hoses for the hydraulic actuator for driving the arm can be piped inside of the boom by employing this structure. Consequently, the rise angle of the boom can be taken to a large level. If this work machine is attached on a turntable of the swivel type vehicle, the minimum swivel radius during the horizontal swiveling of the turntable with respect to the running machine can be decreased. Furthermore, since the strength of the rear surface of the boom is secured, the hose taking-out opening can be largely open, thereby improving the assemblage and the maintenance of the operation oil hoses piped inside of the boom. Furthermore, the hose taking-out opening is hidden and invisible with the brackets erected on its both left and right sides in the boom, whereby the visual appearance is not defaced.

The cover regularly attached on the cover attachment washer inhibits the infiltration of sand, dusts or the like into the boom so that the operation oil hoses piped inside of the boom can be protected. Furthermore, the inclined portion of the cover assists the operation oil hoses to be piped to the hydraulic actuator for driving the arm at an optimal angle so that a slit where sand or dusts or the like are detained between the operation oil hose and the inclined portion can be decreased as much as possible. If a maintenance or another work is to be applied on the operation oil hoses in the boom, the hose taking-out opening can be easily opened by detaching the cover from the cover attachment washer with the result that the work can be done at once.

Furthermore, in a structure in which the operation oil hoses are extended from the inside of the boom to the outside through the hose taking-out opening, a hose attachment plate for allowing the operation oil hoses to pass therethrough is arranged in the vicinity of the bent portion of the boom. The end portion connectors of the operation oil hoses are arranged on the external surface of the hose attachment plate, and the end portions of the operation oil hoses in connection with the hydraulic actuator for the arm is detachably connected to the respective end portion connectors. The hose attachment plate is arranged so that an angle of the hose attachment plate formed with a portion of the rear surface of the boom between the bent portion and the tip end thereof becomes approximately equal to an angle of the hose attachment plate formed with the other portion of the rear surface of the boom between the bent portion and the base end thereof. On the understanding that the operation oil hoses extending from the base pass through the bent portion inside the boom and are extended to the outside of the boom via the hose attachment plate which is shifted to the tip end of the boom from the bent portion of the boom, the operation oil hoses are supported in the vicinity of the bent portion by the hose attachment plate arranged at the above-mentioned angle, thereby being piped smoothly without any obstacles while being abruptly or unnaturally bent in the vicinity of the bent portion of the boom.

Next, according to the present invention, an angle rib fixed onto the tip end of the boom is formed at the surface thereof attached onto the rear surface of the boom with an extension portion which is extended toward the base end of the boom and provided with a open hole communicating the inside and outside of the boom with each other. On the understanding that the open hole is used to pipe therethrough the operation oil hoses (particularly, for the hydraulic actuator for driving the work attachment) up to the tip end of the boom inside the boom or for the maintenance of the hoses, even when the open hole is provided on the tip end of the boom, even when the open hole is provided on the tip end of the boom, the strength of the boom can be secured by providing the open portion on the extension portion of the angle rib. Furthermore, since it becomes unnecessary to provide the reinforcing member such as a reinforcement patch or the like in the periphery of the open hole, the number of constituent members can be decreased. Then, since the strength of the boom can be secured, it is possible to form the open hole in a large size thereby making it possible to facilitate the piping work and the maintenance thereof in the operation oil hoses which are piped in the boom. On the contrary, it is possible to say that the operation hoses can be piped inside of the boom (particularly, for the work attachment) up to the tip end of the boom by providing such an open hole.

Furthermore, the operation oil hose for supplying the operation oil to the hydraulic actuators for driving the work attachment is piped inside of the boom. The angle rib fixed to the tip end of the boom is formed from the forefront end portion thereof up to the rear surface of the boom with an inclined surface, through which the operation oil hoses piped inside of the boom are passed so as to arrange their end portion connectors the external side of the inclined surface. The end portions of the operation oil hoses in connection with the work attachment are detachably connected to the end portion connectors. With such constitution, the bent degree of the operation oil hoses during its flexion can be made smaller than that when the operation oil hoses are piped on the rear surface of the boom. Furthermore, a space required for securing the deflection of the operation oil hoses can be decreased at the connection portion between the tip end of the boom and the base end of the arm because of the decreased deflection amount of the hoses with the result that the outside operation oil hoses connected with the actuator can be piped for their connection to the end portion connectors through between a pair of right and left plates of the bracket for pivoting the hydraulic actuator for the work attachment (a bucket cylinder) provided on the connection portion between the boom and the arm. Consequently, the outside operation oil hoses are protected with the bracket, which makes the visual appearance very neat and tidy.

Next, an object of the present invention is to provide an improvement of the reinforcement structure of the boom, in addition to the piping structure of the operation oil hoses for supplying operation oil to the hydraulic actuators for driving the respective drive parts.

In the beginning, the boom is provided at the base end portion thereof, to which the supported portions to be pivoted onto the boom bracket are joined, with the reinforcement member plastered thereon. The reinforcement member is made of a plate-like member which becomes thinner toward the tip end side of the boom, thereby preventing the boundary portion between the reinforcing plate and the main body of the boom from being concentrically stressed so that the strength of the boom including the main body, the base end support portion and a joint portion between the two portions are secured and improved in its proof against load. The reinforcing plate itself is formed in a thin thickness, thereby being lightened and reduced in its manufacturing cost.

Then, the boom is fixedly provided at the tip end portion of the main body thereof with an arm fulcrum bracket for pivoting the base end of the arm. The arm fulcrum bracket includes a main plate member joined to the tip end of the main body of the boom. A reinforcing plate is plastered onto a forward projecting portion of the main plate member. The main plate member and the reinforcing plate constitute a pivot portion for the base end of the arm. In such a constitution, the arm fulcrum bracket, even if being stressed, is pliable or so on so that the joint portion between the main plate member of the arm fulcrum bracket and the boom from being concentrically stressed. Furthermore, it becomes unnecessary to process the arm fulcrum bracket with a milling machine or the like so that the process step number can be decreased.

The objects, structure and effect of the prevent invention which have been described above and those outside of the description will become more apparent in the following description on the most favorable forms for embodying the present invention referring to the accompanied drawings.

BEST MODE FOR CARRYING OUT THE INVENTION

Figure 1:
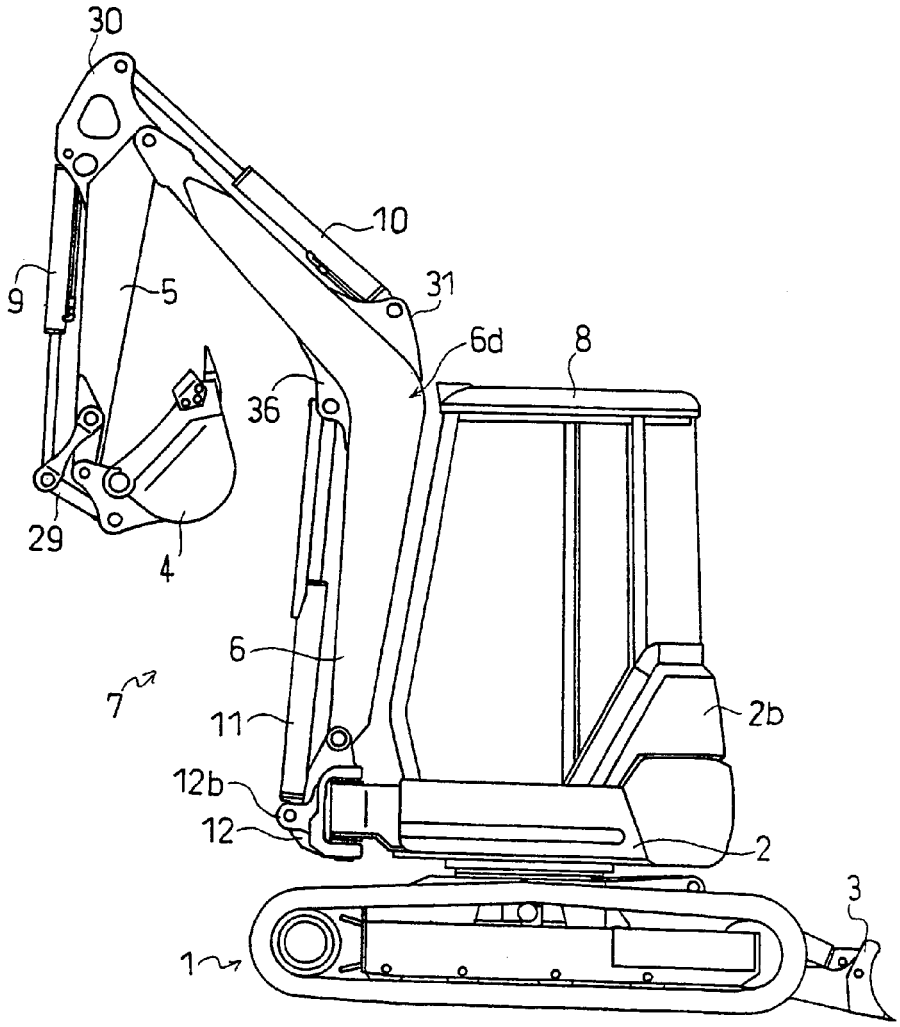
FIG. 1 is a side view of an excavator (a backhoe) as a swivel vehicle having a work machine structure according to the present invention.

In the beginning, there will be described a structure of a backhoe which is a swivel type working vehicle having a work machine structure of the present invention. In FIG. 1, on the center of the upper portion of a crawler type running machine 1 is laterally rotatably supported a turntable 2 serving as a base for attaching the work machine of the present invention thereon. On either front or rear end of the crawler type running machine 1 is vertically rotatably arranged a blade 3.

Above the turntable 2 is arranged a bonnet 2*b* which covers an engine. In front of and above the turntable 2 is arranged a cabin 8 covering an operation room.

A boom bracket 12 is horizontally rotatably attached on a front end portion of the turntable 2 in front of the cabin 8. A base end portion of a boom 6 is vertically rotatably supported by the boom bracket 12.

The boom 6 is bent at its intermediate portion 6*d* into a dogleg shape as seen from the side view thereof. A portion of the boom 6 from the bent portion 6*d* toward a tip end portion is forwardly extended in a rising posture. An arm 5 is rotatably supported on the tip end portion of the boom 6. A bucket 4 is rotatably supported on a tip end of the arm 5. The drive parts such as the boom 6, the arm 5 and the bucket 4 constitute a work machine 7.

Each of the drive parts is rotatably driven with a hydraulically-driven cylinder serving as a hydraulic actuator. The boom 6 is rotatably driven with respect to the boom bracket 12 upon extending and contracting operations of a boom cylinder 11. The arm 5 is rotatably driven with respect to the boom 6 by an arm cylinder 10. The bucket 4 is rotatably driven with respect to the arm 5 by a bucket cylinder 9.

Each of the cylinders 9, 10 and 11 is supplied with operation oil via control valves, operation oil hoses and the like from the hydraulic pump arranged in the bonnet 2*b* on the turntable 2 so as to be driven in its extending and contracting actions.

The boom cylinder 11 is interposed between a boom cylinder support portion 12*b* formed on a front end of the boom bracket 12 (an end portion of the boom bracket 12 facing toward the bucket) and the boom cylinder top bracket 36 provided on the belly surface of the intermediate portion of the boom 6. The arm cylinder 10 is interposed between an arm cylinder bottom bracket 31 provided on the rear surface of the intermediate portion of the boom 6 and a bucket cylinder bracket 30 provided on the rear surface of the base end portion of the arm 5. The bucket cylinder 9 is interposed between the bucket cylinder bracket 30 and a bucket bracket 29 connected to the bucket 4.

The turntable 2 is provided with a frame portion onto which the boom bracket 12 is mounted. End portions of operation oil supplying hoses for each of the hydraulic pressure cylinders 9, 10 and 11 piped from hydraulic pressure controlling devices such as a hydraulic pressure pump, a hydraulic pressure valve and the like arranged inside of the bonnet 2*b* on the turntable 2 is supported by an upper plate portion 2*a* of the frame portion of the turntable 2 (the upper plate of the frame). Connectors of the respective hoses are arranged on the outside of the upper plate portion 2*a*. Then, the operation oil hoses 21, 22 and 23 for each of the hydraulic pressure cylinders piped on the boom 6 or the boom bracket 12 are connected to the respective connectors 25 on the upper plate 2*a* of the frame so as to be integral with the respective operation oil hoses extended from the hydraulic pump in the turntable 2.

For providing the work machine 7 on the turntable 2, the work machine 7 on which the operation oil hoses are previously piped is attached onto the turntable 2 on which the operation oil hoses extended from the hydraulic pressure control devices are previously piped, in other words, the base ends of the boom 6 and the boom cylinder 11 are attached onto the boom bracket 12 as a manner such as discussed later. Then, the piping of the operating oil hoses from the hydraulic pressure control devices up to the respective hydraulic actuators is completed only by connecting the operation oil hoses 21, 22 and 23 to the respective operation oil hoses piped on the turntable 2 via the connectors 25 on the upper plate 2*a* of the frame of the turntable 2 behind the boom bracket 12.

In this manner, the piping work from the hydraulic pressure control devices arranged on the turntable 2 serving as the base up to the hydraulic actuators for the respective drive parts of the work machine is simplified. Besides, for exchanging each of the operation oil hoses piped on the work machine, it is only required that each of the operation oil hoses is detached from the connector 25 on the upper plate 12*a* of the frame. Since it is not necessary to pull out the hose of its whole length from the hydraulic pressure control devices on the turntable, the exchange work is simple and the cost comes cheap.

Next, out of the work machine 7, the support structure of the base end of the boom 6 with the turntable 2 and the piping structure of the operation oil hoses 21, 22, and 23 for the respective hydraulic cylinders on the periphery of the base end portion of the boom will be described by referring to FIGS. 2 through 6.

The boom bracket 12 is laterally rotatably supported on the front end portion of the turntable 2 via a swing pin 13 which is a vertical pivot pin.

The base end portion of the boom 6 is bifurcated to constitute a pair of supported portions 6*a* with the result that an open portion is formed on the base end of the boom between the supported portions 6*a* so that the operation oil hoses extending from the turntable 2 are allowed to be inserted into the boom 6 via the open portion and a piping space of the operation oil hoses is secured between the supported portions 6*a*. On the other hand, the upper end portion of the boom bracket 12 is bifurcated corresponding to each of the supported portions 6*a* to form respective boom support portions 12*a*. Each of the boom support portions 12*a* is further bifurcated so as to sandwich each of the supported portions 6*a* and vertically rotatably pivot it via a horizontal pivot pin 18, whereby the boom 6 is vertically rotatably supported on the boom bracket 12.

Figure 2:
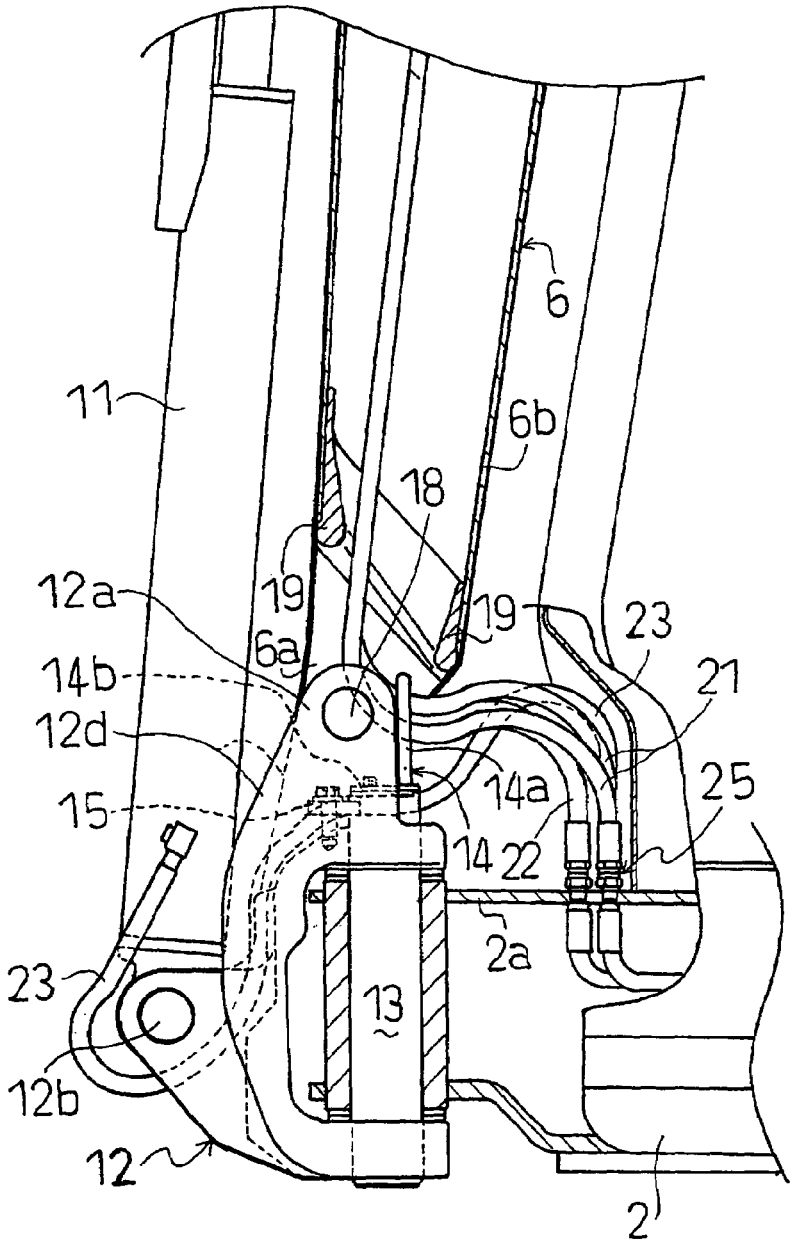
FIG. 2 is a side view showing a support structure of a base end of a boom via a boom bracket onto a turntable and a piping structure of operation oil hoses.
Figure 3:
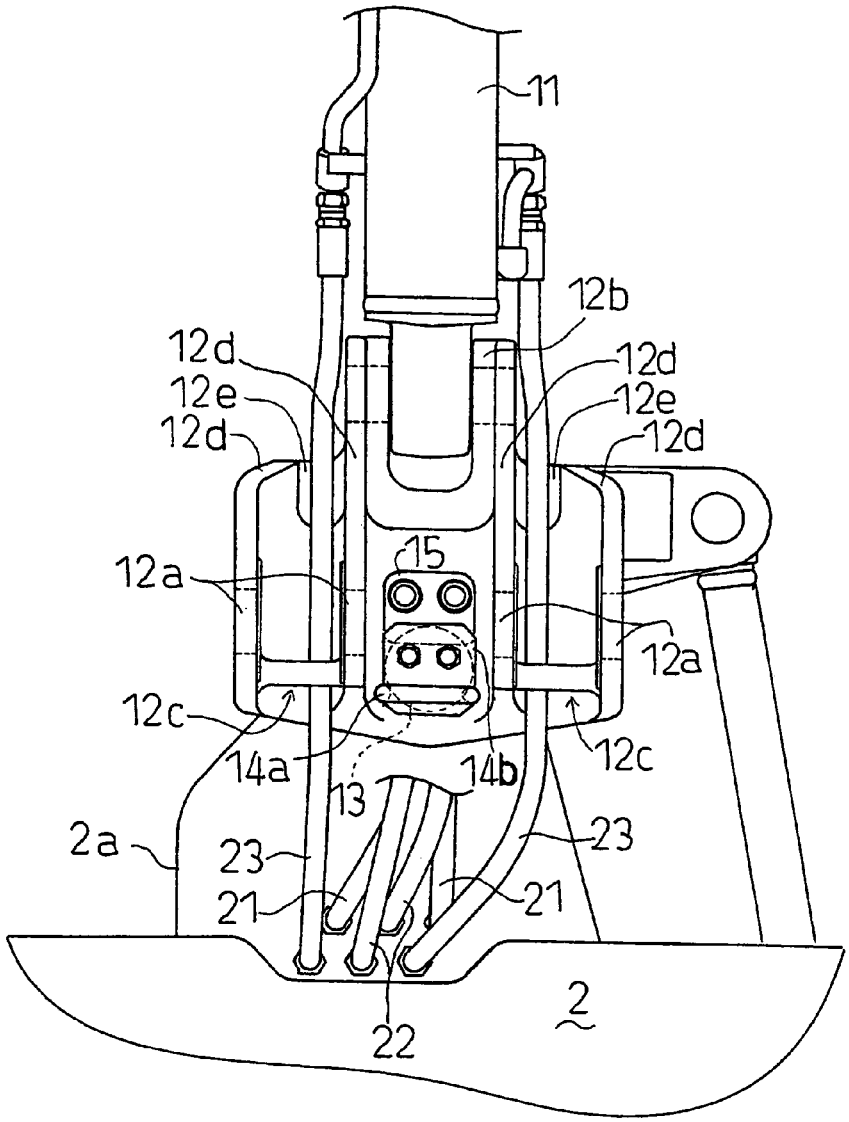
FIG. 3 is a plan view thereof in the same manner.

Since a large load is inflicted on the supported portions 6*a* of the base end of the boom 6 constituting a rotation fulcrum of the boom 6, the supported portions 6*a* are formed of a casting member. A main body 6*b* of the boom 6 on which smaller load is inflicted as compared with the supported portions 6*a* is constituted by bending and joining by welding a plate-like member such as a steel plate or the like for decreasing the weight of the boom 6. The supported portions 6*a* and the boom main body 6*b* are joined with each other by welding or the like. As shown in FIG. 2, on the inside of the joint portion is plastered a reinforcing plate 19 formed of a plate-like member or casting.

The reinforcing plate 19 is formed in such a manner that its base end portion in contact with the supported portions 6*a* is thick and its portion in contact with the boom main body 6*b* becomes thinner toward the tip end of the boom 6.

In this manner, the reinforcing plate 19 is formed so as to be thinner from the base end toward the tip end of the boom 6 (when the boom 6 is raised, from the lower end toward the upper end thereof) so that the strength of its portion in contact with the boom main body 6*b* is reduced. Consequently, in the case where a stress is applied to the supported portions 6*a*, the boom main body 6*b* made of a plate-like member, even its portion where the reinforcement plate 19 is plastered, is bowed so as to allow the stress to escape, thereby being alleviated. In other words, the stress to the boom 6 is not concentrated on the boundary portion between the reinforcing plate 19 and the main body 6*b*. Endurance against load can be improved by securing the strength of the boom 6 including the joint portion of the main body 6*a* with the supported portions 6*a*. Furthermore, an attempt can be made to decrease the weight of the reinforcing plate 19 and decrease the cost thereof by forming such a thin portion on the reinforcing plate 19.

A base end portion of the boom cylinder 11 which is interposed between the boom 6 and the boom bracket 12 is rotatably supported with the boom cylinder support portion 12*b* of the boom bracket 12.

From the respective connectors 25 provided on the upper plate 2*a* on the front portion frame of the turntable 2 are forwardly extended the operation oil hoses 23 for the boom cylinder, the operation oil hoses 23 for the arm cylinder, and the operation oil hoses 22 for the bucket cylinder. The operation oil hoses 22 for the arm cylinder and the operation oil hoses 21 for the bucket cylinder are piped from the open portion formed between the supported portions 6*a* of the bifurcated boom 6 so as to supply the operation oil discharged from the hydraulic pressure pump arranged inside of the bonnet 9 to the arm cylinder 10 and the bucket cylinder 9.

On the understanding that each of the operation oil hoses 21, 22 and 23 is provided with a deflection space in the scope between the front portion of the turntable 2 and the boom 6 because the required length of each of the operation oil hoses 21, 22 and 23 from the front portion of the turntable 2 up to each of the cylinders 11, 10 and 9 is varied depending upon the rotation posture of the boom 6, each of the operation oil hoses 21, 22 and 23 is piped so as to pass through the vicinity of the supported portions 6*a* serving as a rotation fulcrum of the boom 6, or the vicinity of a cylinder supported portion 12*b* of the boom bracket 12, thereby decreasing the deflection space of each of the hoses 21, 22 and 23. The constitution thereof will be described hereinbelow.

Figure 6:
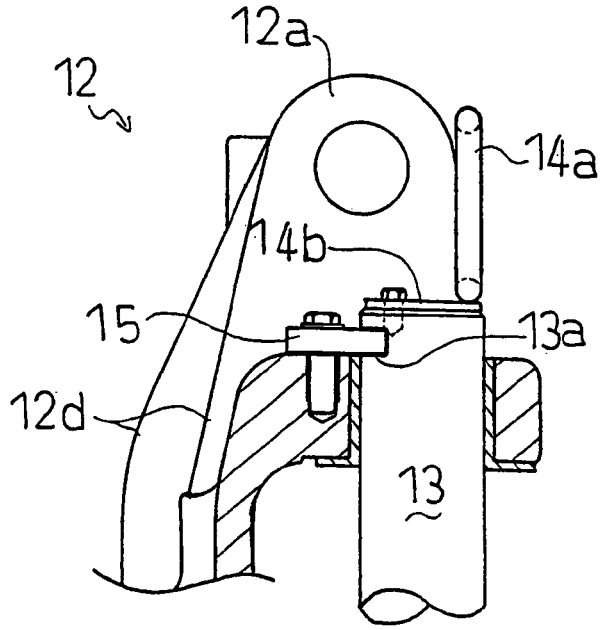
FIG. 6 is a side view showing an attachment structure of a hose guide and a position fixing structure of a swing pin.

The swing pin 13, which connects the front end portion of the turntable 2 and the boom bracket 12, passes through the boom bracket 12 in a vertical direction, and an upper end portion of the swing pin 13 upwardly projects higher than the upper surface of the boom bracket 12 between the respective boom support portions 12*a*. As shown in FIG. 6, a notch portion 13*a* is formed on the side of the projection portion of the swing pin 13, and a rotation stopper plate 15 fixed to the upper surface of the boom bracket 12 with a bolt or the like is engaged with the notch portion 13*a* so that the swing pin 13 is not rotated with respect to the boom bracket 12, namely, the swing pin 13 and the boom bracket 12 are integrally rotated.

Furthermore, on the upper surface of the swing pin 13 is fixed a base plate 14*b* of a hose guide 14 with a bolt or the like. In a plan view, the external configuration of the base plate 14*b* is formed in a size larger than the external configuration of the swing pin 13 so that, when the swing pin 13 is moved downward, the base plate 14*b* can engage with the upper surface of the boom bracket 12.

Figure 4:
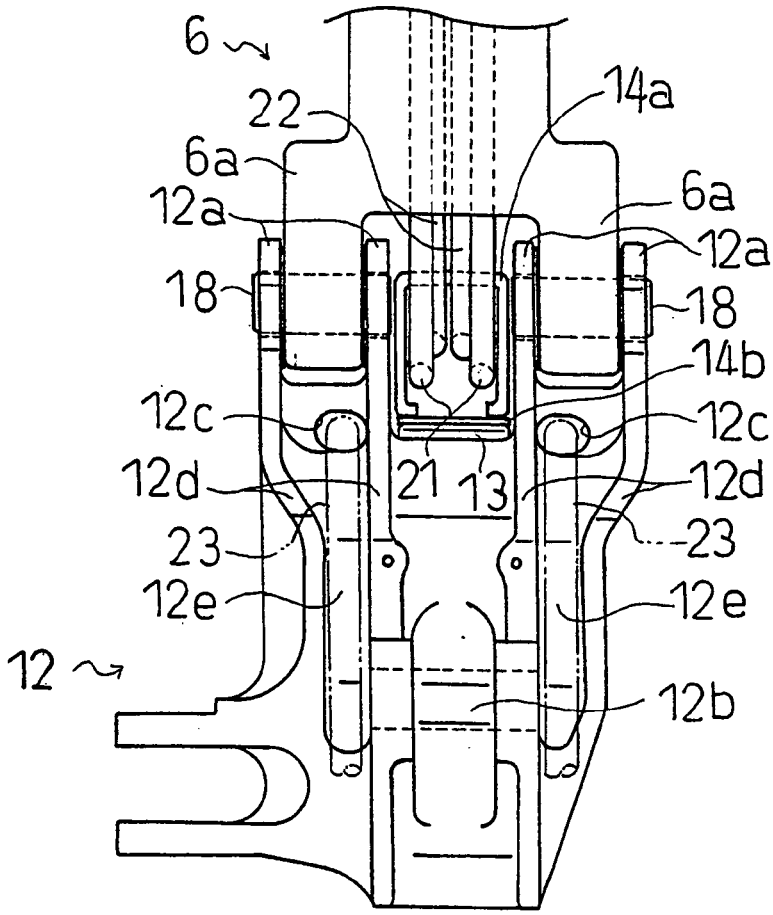
FIG. 4 is a front view of the boom bracket which supports supported portions provided on the base end of the boom.
Figure 5:
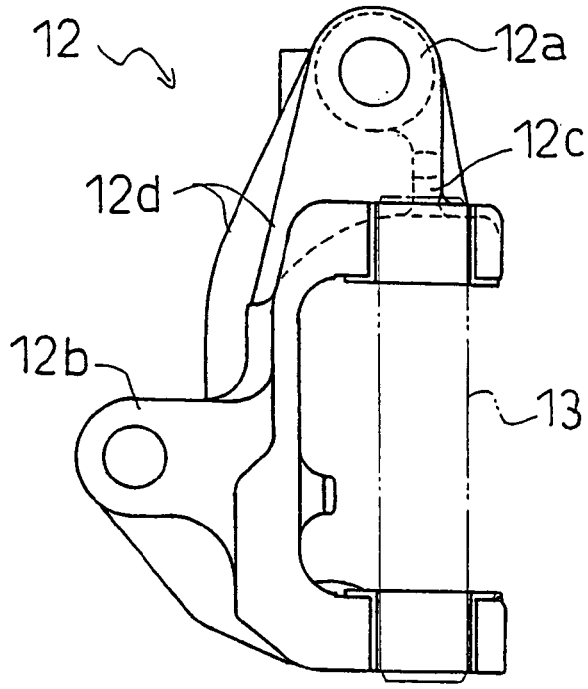
FIG. 5 is a side view of the boom bracket.

On the upper surface of the base plate 14*b*, for example, a guide portion 14*a* formed into an approximately hook-like configuration by bending a bar-like member is erected in a porch-like form. In the plan view, as shown in FIG. 4, the guide portion 14*a* is located between both the right and left boom support portions 12*a*. Then, out of the operation oil hoses 21, 22 and 23 extending from the turntable 2, the pair of operation oil hoses 21 for the bucket cylinder and the pair of operation oil hose 22 for the arm cylinder pass through the guide portion 14*a*, and then, they are guided and piped into the inside of the boom 6 through between the right and left boom support portions 12*a*.

The hose guide 14, the swing pin 13 and the boom bracket 12 can be integrally rotated with respect to the turntable 2. Consequently, even if the boom bracket 12 is rotated leftward or rightward, the guide direction of each of the operation oil hoses 22 and 23 by the hose guide 14 is varied in accordance with the rotation direction, thereby preventing each of the operation oil hoses 22 and 23 from being damaged in contact with the boom bracket 12 or the boom 6.

On the other hand, the boom bracket 12 is provided below the boom support portions 12*a* thereof with respctive hose guide holes 12*c*. Furthermore, the boom bracket 12 is provided from both left and right sides of each of the boom support portions 12*a* thereof with respective ribs 12*d* which project forward and extend downward. In this constitution, the pair of operation oil hose 21 for the boom cylinder from the front portion of the turntable 2 are extended in a forward direction through the respective hose guide holes 12*c*. Furthermore, each of the operation hoses 21 is extended in a downward direction through a valley 12*e* between the pair of ribs 12*d* provided on both sides of each of the boom support portions 12*a* below each of the hose guide holes 12*c*, and detours around both the left and right sides of the boom cylinder support portion 12*d* so as to be connected to each of left and right ports of the boom cylinder 11. Consequently, the operation oil hoses 21 are extremely shortened as compared with those piped from the rear surface of the boom up to the boom cylinder via the left and right side surfaces of the boom. Besides, the operation oil hoses 21 are protected with the boom bracket 12 so as to be less visual, thereby contributing to a neat appearance.

Conventionally, since the operation oil hoses for each of the hydraulic cylinders extending from the turntable behind the base end of the boom is guided onto the rear surface of the boom, the deflection space of the hoses for allowing the rotation of the boom is taken at the rear of the base end of the boom. In contrast, in this embodiment, at the rear of the boom bracket, the operation oil hoses 22 and 23 are guided into the guide member 14*c* of the hose guide 14 in the substantially shortest distance while the operation oil hoses 21 are guided into the respective hose guide holes 12 in the substantially shortest distance. Then, the deflection space of the operation oil hoses 22 and 23 for the bucket cylinder 9 and the arm cylinder 10 is secured from the space between both the support portions 12*b* in front of the hose guide member 14*a* up to the space of the open portion between both the supported portions 6*a* at the base end of both booms, namely, in the space somewhat below the portion between both the supported portions 6*a* at the base end of the boom 6. Furthermore, the deflection space of the operation oil hoses 21 for the boom cylinder 11 is secured in a forward space from the valley 12*e* formed between the ribs 12*d* in front of the boom bracket 12. Consequently, the piping portion of the operation oil hoses 21, 22 and 23 provided from the upper plate 12*a* of the frame behind the boom bracket 12 up to the guide member 14*a* and the hose guide hole 12*c* in the boom bracket 12 is hardly deflected despite the rotation of the boom 6. (However, the deflection space is required only for corresponding to the right and the left rotation of the boom bracket 12 with respect to the turntable 2). Consequently, the boom bracket 12, which is conventionally arranged forwardly apart from the front surface of the cabin 8 on the turntable 2 in order to secure the deflection space at the rear of the boom, can be allowed to come close to the front surface of the cabin 8 at the rear thereof and the minimum swivel radius during the horizontal swivel of the turntable 2 can be decreased more than that of the conventional structure. Furthermore, the center of gravity of the turntable 2, which is conventionally shifted forward, can be allowed to come close to the central portion of the turntable 2 so that the stability thereof is heightened.

Figure 7:
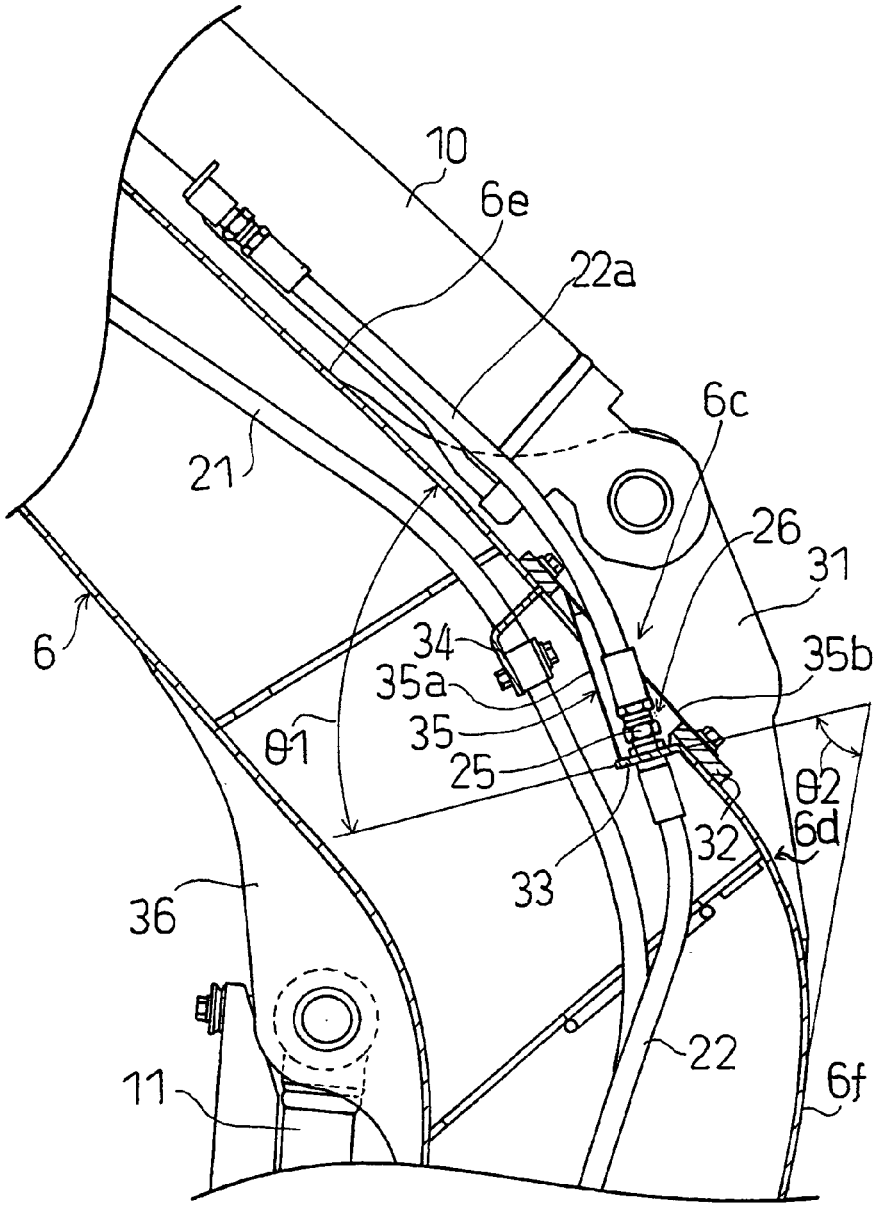
FIG. 7 is a side view showing a piping structure of operation oil hoses for an arm cylinder at an intermediate portion of the boom.
Figure 8:
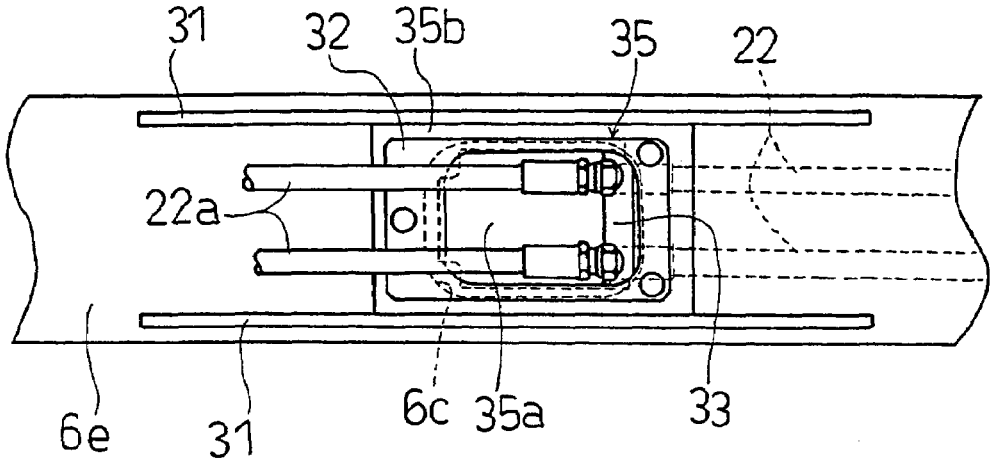
FIG. 8 is a plan view thereof in the same manner.

Next, the structure of the intermediate portion of the boom 6 and the piping structure thereof will be described by referring to FIGS. 1, 7 and 8. As described above, the boom 6 is bent at the intermediate portion thereof so as to be doglegged when viewed in side. On the rear surface of the intermediate portion of the boom 6 is provided a pair of plate-like arm cylinder bottom brackets 31. A pair of bucket cylinder brackets 30 are provided on the base end portion of the arm 5. The arm cylinder 10 for rotating the arm 5 is interposed between the arm cylinder bottom bracket 31 and the bucket cylinder bracket 30. A tip end of a piston rod of the arm cylinder 10 is supported by the bucket cylinder brackets 30. A bottom end of the arm cylinder 10 is supported by the arm cylinder bottom brackets 31.

Both the right and left arm cylinder bottom brackets 31 are arranged in the vicinity of the bent portion 6*d*. Between both arm cylinder bottom brackets 31, a hose taking-out opening 6*c* communicating the inside and the outside of the boom 6 is formed on the rear surface of the boom 6.

The hose taking-out opening 6*c* is open at a tip side rear surface 6*e* formed in a planar configuration from the bent portion 6*d* up to the tip end portion. The operation oil hoses 22 for the arm cylinder extending from the turntable 2 and attached inside of the boom 6 is pulled to the outside through the hose taking-out opening 6*c* so as to be connected to the arm cylinder 10.

Furthermore, on the peripheral portion of the hose taking-out opening 6*c* is fixed a cover attachment washer 32 formed of a thick plate-like member. The cover attachment washer 32 is fixedly provided on its end fringe toward the base end (the rear end fringe) with a hose attachment plate 33 projecting into the inside of the boom 6. The pair of operation oil hoses 22 for the arm cylinder piped inside the boom 6 penetrates the hose attachment plate 33 so that the end portion connectors 25 thereof are arranged on the outside of the hose attachment plate 33. Then, on the outside of the boom 6, a pair of operation oil hoses 22*a* connected to respective ports of the arm cylinder 10 arranged as described above are detachably connected to the end portion connectors 25. In this manner, the operation oil hoses are provided with divisible connection portion 26 on the hose attachment plate 33.

The hose attachment plate 33 is arranged with an inclination of a definite angle of θ1 toward the belly of the boom 6 with respect to the tip side rear surface 6*e* of the boom 6. The operation oil hoses 22 for the arm cylinder are supported substantially perpendicularly the surface direction of the hose attachment plate 33.

Then, an arrangement is established so that the angle θ1 of the hose attachment plate 33 formed with the tip side rear surface 6*e* is substantially equal to an angle θ2 of the hose attachment plate 33 formed with a base side rear surface 6*f* which is arranged from the bent portion 6*d* toward the base end of the boom 6. In other words, the angle θ1 of the hose attachment plate 33 formed with the upper rear surface 6*e* is substantially half of the angle formed with the tip side rear surface 6*e* and the base side rear surface 6*f* (namely, the dogleg angle of the boom 6).

Furthermore, a cover 35 is attached from the outside on the cover attachment washer 32 to seal the hose taking-out opening 6*c*, thereby preventing the infiltration of sands, dusts or the like into the boom 6. The cover 35 comprises a fixed portion 35*b* attached and fixed to the cover attachment washer 32 with bolts or the like, and a cover portion 35*a* sealing the hose taking-out opening 6*c*. The cover portion 35*a* is formed to enter into the inside of the boom 6 in a diagonal direction from the tip side end fringe (the front end fringe) of the cover attachment washer 32 toward the base end side (backward). Along the inclined surface of the cover portion 35*a* are piped the pair of operation oil hoses (external hoses) 22*a* extending from the respective end portion connectors 25 on the hose attachment plate 33. That is, the inclination angle of the cover portion 35*a* is set in accordance with the piping angle of the external hoses 22*a*. Due to this arrangement in combination with the angle of the hose attachment plate 33 arranged as mentioned above, the external hoses 22*a* connected with the operation oil hoses 22 provided inside the boom 6 can be smoothly piped up to the respective ports of the arm cylinder 10 without any obstacles.

Furthermore, an operation oil hose guide member 34 is fixed to the tip side end fringe (the front end fringe) of the cover attachment washer 32 so as to project into the inside of the boom 6. Inside of the boom 6, the pair of operation oil hoses 21 for the bucket cylinder are guided and supported with the operation oil hose guide member 34.

The hose taking-out opening 6*c* is easily opened by detaching the cover 35 so that the operation oil hoses 21 for the bucket cylinder can be attached onto and detached from the hose guide member 34 and the operation oil hose 22 can be attached onto and detached from the attachment plate 33, thereby enabling the piping and maintenance of the operation oil hoses.

The boom 6, while being provided with the hose taking-out opening 6*c*, is sufficiently reinforced with the strong arm cylinder bottom brackets 31 erected on the left and right sides of the hose taking-out opening 6*c* and with the cover attachment washer 32 fixed to the peripheral portion of the hose taking-out opening 6*c*. Thus, the boom 6 can be applied to the large-scale work machine. Furthermore, because of this reinforcement structure, an open area of the hose attachment opening 6*c* can be largely secured so as to facilitate the piping and the maintenance work of the operation oil hoses 21 or the like piped inside of the boom 6 by detaching the cover 35.

Furthermore, the hose taking-out opening 6*c* is hidden in the right and left bottom brackets 31 so as to be invisible so that the appearance is not defaced.

Furthermore, the rise angle of the boom can be largely taken by attaching the operation oil hose such as the operation oil hoses 22 or the like inside of the boom, thereby enabling the minimum swivel radius to be decreased.

Figure 9:
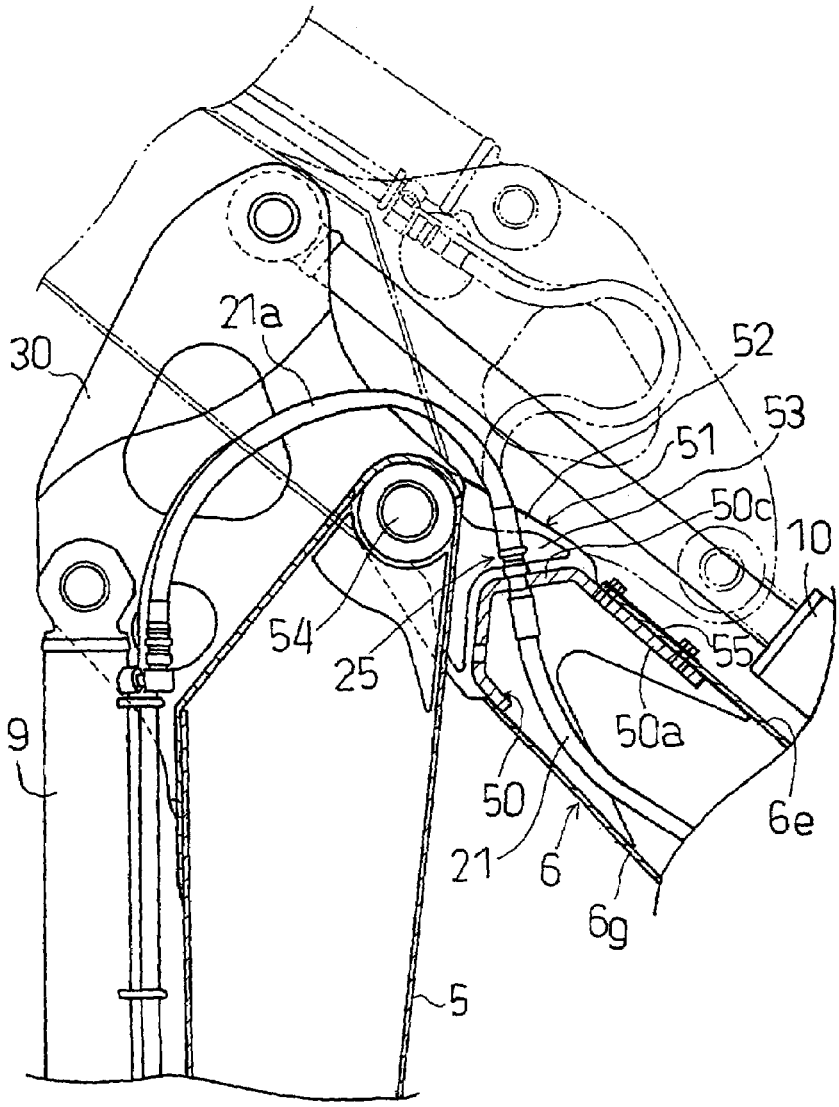
FIG. 9 is a side view of a connection portion of the boom and the arm.

Next, the structure of the tip end portion of the boom 6 and the piping structure of the operation oil hoses for the hydraulic cylinder (for the bucket cylinder) arranged therearound will be described by referring to FIGS. 1, 9 and 10.

On the tip end portion of the boom 6 are fixed an angle rib 50 and a pair of right and left arm fulcrum brackets 51. The angle rib 50 is formed of a bent plate-like member and is attached so as to connect the tip end portion of the belly surface 6*g* and the tip end portion of the rear surface 6*e* of the boom 6. The attachment portion of the angle rib 50 to the rear surface 6*e* of the boom 6 is extended toward the base end portion of the boom 6 along the inside surface of the rear surface 6*e* so as to form an extension portion 50*a*.

Furthermore, when viewed in side, a portion of the angle rib 50 connecting the belly surface 6*g* and the rear surface 6*e* of the boom 6 convexly projects forward than the tip end of the boom 6. The angle rib 50 is provided from the tip end of the convexed portion thereof to the rear extension portion 50*c* with an inclined rear surface 50*c*.

The angle rib 50 is provided on the extension portion 50*a* thereof with an open hole 50*b*, which is, for example, approximately circular, communicating the inside and the outside of the boom 6 so that maintenance or the like can be conducted to the operation oil hoses 21 for the bucket cylinder piped in the boom 6 from the open hole 50*b*.

Figure 10:
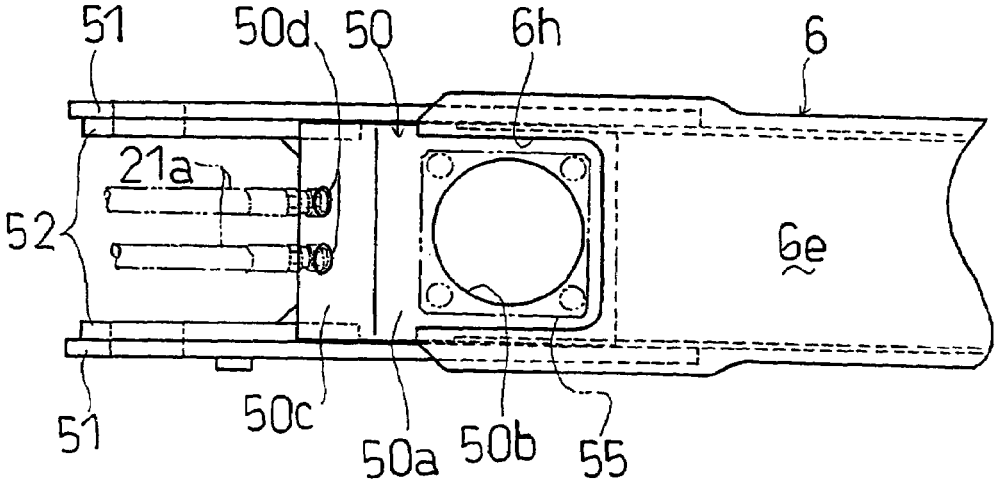
FIG. 10 is a plan view thereof in the same manner.

Furthermore, as shown in FIG. 10, the boom 6 is provided at its tip end portion facing the open hole 50*b* with a notch portion 6*h*.

Then, on the open hole 50*b*, the cover body 55 is detachably attached from the outside to close the open hole 50*b* so that sands, dusts or the like are not infiltrated into the boom 6 at the time of using the work machine unless maintenance or the like is conducted.

In this manner, the tip end portion of the boom 6, while being provided with the notch portion 6*h* on the upper rear surface 6*e* and with the open hole 50*b*, is provided with the extension portion 50*a* of the angle rib 50 which is constituted of a thick plate-like member, thereby securing the strength of the boom 6.

As a consequence, it becomes unnecessary to provide a reinforcing member such as a reinforcing patch or the like on the periphery of the open hole 50*b* so that the number of the constituent members can be decreased. Furthermore, since it is possible to secure the strength of the boom 6, the open hole 50*b* can be formed in a large size so that the assemblage work such as piping work or the like and maintenance of the operation oil hoses 21 for the bucket cylinder can be improved.

On the other hand, the arm fulcrum bracket 51 is constituted by plastering a main plate 52 formed of a thin plate-like member and a reinforcing member 53 with each other, and the main plate 52 is fixed to the tip end portion of the main body of the boom 6 by welding or the like to be extended forward from the tip end of the main body of the boom 6.

The reinforcing plate 53 is plastered to the inside surface of the portion of the main plate 52 extending from the tip end of the boom 6. That is, for the joint of the arm fulcrum bracket 51 to the tip end portion of the boom 6, only the thin plate-like main plate 52 is joined to the boom 6. Then, on the end portion of the arm fulcrum bracket 51, a pivot portion for pivoting the base end of the arm 5 is constituted of the main plate 52 and the reinforcing plate 53. The base end of the arm 5 is pivoted onto the pivot portion via a horizontal pivot pin 54.

In this manner, in the joint portion of the arm fulcrum bracket 51 and the boom 6 where only the thin plate-like main plate 52 is joined with the boom 6, the main plate 52 is bowed or so on, thereby preventing the stress from concentrating on the joint portion. On the other hand, due to the plastering of both the plate members 52 and 53 to each other, the pivot portion is secured in its strength for pivoting the base end of the arm 5. Conventionally, an arm fulcrum bracket comprising one member is processed with a milling machine or the like so that its joint portion to a boom is formed to a thin configuration and its pivot portion for pivoting the base end of an arm is formed to a thick configuration. However, in this embodiment, the arm fulcrum bracket 51 can be constituted by the two plate members 52 and 53 plastered to each other with fewer processes and lower costs so as to have the same function with the conventional.

The end portions of the pair of operation oil hoses 21 for the bucket cylinder provided in the boom 6 are piped substantially perpendicularly to the inclined rear surface 50*c* of the angle rib 50, and pulled outward through respective holes 50*d* formed in the rear inclined surface 50*c*, so that the end portion connectors 25 of the end portions are arranged on the outside of the rear inclined surface 50*c*. A pair of operation oil hoses (external hoses) 21*a* in connection with respective ports of the bucket cylinder 9 are connected to the respective end portion connectors 25.

The external hoses 21*a* extended from the operation oil hoses 21 piped inside the boom 6 via the end portion connectors 25 on the external rear inclined surface 50*c* extend in the shortest distance in a space between the left and right bucket cylinder brackets 30 fixed to the base end portion of the arm 5. On the contrary, it is possible to say that the inclination angle of the rear inclined surface 50*c* is set so as to pipe the external hoses 21*a* in this manner.

For corresponding to the rotation of the arm 5, the external hoses 21*a* are piped in the length which is required in the case where the arm 5 is rotated to the lowest limit so that the distance between the rear inclined surface 50*c* and the bucket cylinder 9 becomes the maximum. In this arrangement, when the arm cylinder 10 is contracted so as to upwardly rotate the arm 5, the external hoses 21*a* are deflected. If the operation oil hoses for the bucket cylinder are piped on the rear surface of the boom in the conventional manner, the deflection of the hoses during the upward rotation of the arm is generated toward the boom rather than the arm so that the degree of bending of the hoses is intended to be large. In contrast, in this embodiment, the external hoses 20*a* are deflected at the position forward than the tip end of the boom (in case of the rising of the boom, higher than the conventional deflection position), so that the bending degree thereof can be set smaller than the conventional example, and the endurance degree of the hoses can be increased. Furthermore, since the deflection position is secured between the right and left bucket cylinder brackets 30, the hoses are not exposed to the outside, thereby being nicely protected without impairment of the appearance.

INDUSTRIAL APPLICABILITY

As applicability of the invention, it is considered that the hydraulically driven work machine according to the present invention described above is primarily attached on a swivel type vehicle so as to constitute a swivel type excavator. Alternatively, the work machine of the invention may be attached on a tractor, or besides vehicles, it may be attached on a structure having a hydraulic control devices such as a hydraulic pump, a hydraulic valve and the like. In particular, in the case where the work machine is attached on the swivel type vehicle, a swivel type working vehicle having a smaller minimum swiveling radius can be provided because its operation oil hoses for the hydraulic actuators are piped inside of the boom and are reduced in their deflection at the rear of the boom.

Furthermore, the present invention, while having the structure that operation oil hoses piped in the boom, is provided with open portions so as to enable the hoses in the boom to be maintained therethrough. It is also provided with the divisional connection of the hoses inside and outside of the boom so as to facilitate the piping work, thereby being improved in the efficiency of its manufacturing process and facilitating its maintenance by users. Then, since the boom having the open portions is devised in its reinforcement so as to secure its strength, such a work machine structure can be applied to a large-scale work machine so that the above advantage can be obtained with the large-scale work machine as well.

What is claimed is:

1. A structure of a work machine having a plurality of drive parts which are individually driven and controlled with hydraulic pressure, comprising:

a base;

a boom bracket horizontally rotatably mounted on the base;

a boom serving as one of the drive parts, the boom being vertically rotatably attached on the boom bracket;

a pivot pin vertically penetrating the base and the boom bracket so that the base and the boom bracket are tightened thereon while the base and boom bracket being horizontally rotatable with respect to each other;

hydraulic actuators for driving the respective drive parts;

a hose guide member fixed to an upper end portion of the pivot pin so that the hose guide member and the boom bracket can be integrally rotated horizontally with respect to the base, and operation oil hoses extended from the base for supplying operation oil to the hydraulic actuators, wherein the operation oil hoses are guided and piped to the inside of the boom via the hose guide member.

2. The work machine structure according to claim 1, further comprising:

an arm serving as one of the drive parts, the arm being relatively rotatably attached on a tip end of the boom, and a work attachment serving as one of the drive parts, the work attachment being relatively rotatably attached on a tip end of the arm, wherein the operation oil hoses which are guided and piped into the boom via the hose guide member are provided for supplying the operation oil to the respective hydraulic actuators for driving the work attachment and the arm.

3. A structure of a work machine as defined in claim 1, further comprising:

the base including an upper plate portion arranged in the vicinity of the work machine;

wherein said operation oil hoses comprise a first plurality of operation oil hoses extending from the base for supplying operation oil to the respective hydraulic actuators;

end portion connectors of the first plurality of operation oil hoses being arranged on the upper plate portion, and wherein said operation oil hoses comprise a second plurality of operation oil hoses piped on the work machine to be connected to the respective hydraulic actuators, wherein end portions of the second plurality of operation oil hoses piped on the work machine are detachably connected to the respective end portion connectors of the first plurality of operation oil hoses extending from the base.

4. A structure of a work machine having a plurality of drive parts which are individually controlled and driven with hydraulic pressure, comprising:

a base;

a boom serving as one of the drive parts, the boom being pivoted at its base end on the base;

an arm serving as one of the drive parts, the arm being pivoted on a tip end of the boom;

a hydraulic actuator for driving the arm;

an operation oil hose piped inside of the boom for supplying operation oil to the hydraulic actuator, and a pair of mutually oppositely located brackets for pivoting a base end of the hydraulic actuator, the pair of brackets being arranged on a rear surface of the boom, wherein the boom is provided on its rear surface between the brackets with a hose taking-out opening for pulling the operation oil hose from the inside of the boom to the outside through said pair of brackets.

5. The work machine structure according to claim 4, wherein the boom is bent at its intermediate portion so as to be substantially doglegged, wherein the brackets are arranged in the vicinity of the bent intermediate portion of the boom, wherein the hose taking-out opening is open at the rear surface of the boom shifted to the arm from the bent portion, further comprising:

a cover attachment washer fixed to the peripheral portion of the hose taking-out opening so as to reinforce the peripheral portion of the hose taking-out opening in the boom, wherein a cover can be attached on the cover attachment washer for sealing the hose taking-out opening while allowing the piping of the operation oil hose to the hydraulic actuator for driving the arm.

6. The work machine structure according to claim 4, further comprising:

a cover for sealing the hose taking-out opening, the cover being attached on a portion of the rear surface of the boom forming the hose taking-out opening while allowing the piping of the hose for supplying operation oil to the hydraulic actuator for driving the arm, wherein the cover has an inclined portion from the rear surface of the boom to the inside of the boom along the hose.

7. A structure of a work machine having a plurality of drive parts which are individually controlled and driven with hydraulic pressure, comprising:

a base;

a boom serving as one of the drive parts, the boom being pivoted at its base end on the base, wherein the boom is bent at an intermediate portion thereof so as to be substantially doglegged, and wherein the boom has a rear surface between the bent portion and the tip end thereof, and a rear surface between the bent portion and the base end thereof;

an arm serving as one of the drive parts, the arm being pivoted on a tip end of the boom;

a hydraulic actuator for driving the arm;

a first operation oil hose for supplying operation oil to the hydraulic actuator, the first operating oil hose being piped inside of the boom, a hose attachment plate arranged in the vicinity of the bent portion of the boom, wherein the first operation oil hose piped inside the boom penetrates through the hose attachment plate;

an end portion connector of the first operation oil hose, the end portion connector being arranged on the external surface of the hose attachment plate, and a second operation oil hose connected to the hydraulic actuator, an end portion of the second operation oil hose connected to the hydraulic actuator being detachably connected to the end portion connector of the first operation oil hose piped inside of the boom, wherein the hose attachment plate is arranged in such a manner that an angle thereof formed with the rear surface of the boom between the bent portion and the tip end becomes substantially equal to another angle thereof formed with the rear surface of the boom between the bent portion and the base end.

8. A structure of a work machine having a plurality of drive parts which are individually controlled and driven with hydraulic pressure, comprising:

a base;

a boom serving as one of the drive parts, the boom being pivoted at its base end on the base;

an angle rib fixed to a tip end of the boom, wherein a surface of the angle rib attached to a rear surface of the boom is extended toward the base end of the boom so as to form an extension portion, and an open hole communicating the inside and the outside of the boom, the open hole being formed on the extension portion.

9. A structure of a work machine having a plurality of drive parts which are individually controlled and driven with hydraulic pressure, comprising:

a base;

a boom serving as one of the drive parts, the boom being pivoted at its base end on the base;

an arm serving as one of the drive parts, the arm being pivoted on a tip end of the boom;

a work attachment serving as one of the drive parts, the work attachment being pivoted on a tip end of the arm;

a hydraulic actuator for driving the work attachment;

a first operation oil hose for supplying operation oil to the hydraulic actuator, the first operation oil hose being piped inside of the boom;

an angle rib fixed to the tip end of the boom, wherein the angle rib is provided with an inclined surface from a tip end portion of the angle rib to a rear surface of the boom, and wherein the first operation oil hose piped inside of the boom penetrates the inclined surface;

an end portion connector of the first operation oil hose being arranged on an external side of the inclined surface, and a second operation oil hose connected to the work attachment, wherein an end portion of the second operation oil hose connected to the work attachment is detachably connected to the end portion connector of the first operation oil hose piped inside of the boom.

10. A structure of a work machine having a plurality of drive parts which are individually controlled and driven with hydraulic pressure, comprising:

a base;

a boom serving as one of the drive parts, the boom being pivoted at its base end on the base;

an arm serving as one of the drive parts, the arm being pivoted on a tip end of the boom;

an arm fulcrum bracket fixed to the tip end portion of a main body of the boom for pivoting a base end of the arm, the arm fulcrum bracket including a main plate member, a reinforcement plate, the main plate member being joined to the tip end portion of the boom and projecting further than the tip end portion of the main body of the boom, the reinforcement plate being plastered on and contained within an interior surface of the projecting portion of the main plate member, so that the main plate member and the reinforcing plate constitute a pivoting portion for pivoting the base end of the arm.

* * * * *